US009689644B1

(12) United States Patent
Zhang et al.

(10) Patent No.: US 9,689,644 B1
(45) Date of Patent: Jun. 27, 2017

(54) PHOTOELECTRIC SIGHTING DEVICE CAPABLE OF PERFORMING 3D POSITIONING AND DISPLAY OF TARGET OBJECT

(71) Applicant: Huntercraft Limited, Albany, NY (US)

(72) Inventors: Lin Zhang, Albany, NY (US); Chunhua Shi, Albany, NY (US); Sang Su, Albany, NY (US)

(73) Assignee: HUNTERCRAFT LIMITED, Albany, NY (US)

( * ) Notice: Subject to any disclaimer, the term of this patent is extended or adjusted under 35 U.S.C. 154(b) by 0 days.

(21) Appl. No.: 14/978,712

(22) Filed: Dec. 22, 2015

(51) Int. Cl.
*G06F 19/00* (2011.01)
*F41G 3/06* (2006.01)

(52) U.S. Cl.
CPC ..... *F41G 3/06* (2013.01)

(58) Field of Classification Search
USPC ..... 235/404, 408, 414
See application file for complete search history.

(56) References Cited

U.S. PATENT DOCUMENTS

2012/0126001 A1* 5/2012 Justice ..... F41G 1/38 235/404
2015/0247702 A1* 9/2015 Davidson ..... F41G 1/38 42/122
2016/0138890 A1* 5/2016 Hofmann ..... F41G 1/38 345/59
2016/0231083 A1* 8/2016 Regan ..... F41G 1/38
2016/0290764 A1* 10/2016 Chen ..... F41G 3/00

* cited by examiner

*Primary Examiner* — Ahshik Kim
(74) *Attorney, Agent, or Firm* — Novick, Kim & Lee, PLLC; Allen Xue

(57) ABSTRACT

The present invention relates to the technical field of sighting, and specifically relates to a photoelectric sighting device capable of performing 3D positioning and display of a target object. The invention provides a photoelectric sighting device realizing integration of range-finding unit and multiple sensors and capable of performing 3D positioning to a target object. In the process of sighting, a target object is positioned, and displayed in the same 3D coordinate system together with the sighting device, so as to be sighted; the invention also provides a calibration method of sighting device, combined with the 3D positioning of a target object by the sighting device, such that a user calibrates a firearm before shooting.

18 Claims, 10 Drawing Sheets

PHOTOELECTRIC SIGHTING DEVICE CAPABLE OF PERFORMING 3D POSITIONING AND DISPLAY OF TARGET OBJECT

TECHNICAL FIELD

The present invention relates to the technical field of sighting, and more specifically relates to a photoelectric sighting device capable of performing 3D positioning and display of a target object.

BACKGROUND

Traditional sights usually include mechanical sights and optical sights, wherein the mechanical sights generally refer to performing sighting mechanically through a metallic sight such as a rear sight, a front sight, and a notch; the optical sights refer to imaging with optical lens, where a target image and a line of sight are superimposed on a same focal plane, such that a point of sighting will not be affected even with slight eye offset.

With technical development, more techniques are applied to the technical field of sighting device, for example, distance measurement and sensor techniques are applied to the sighting device. It is impossible to realize high integration of range-finding unit on the sighting device, and to realize miniaturization, and for the sensor technique applied to the sighting device, there are only several simple sensors such as temperature sensors. Although many advanced techniques are applied, traditional sighting manner is still not changed, and users perform sighting only through a two-dimensional image of the field of view and cannot realize precise positioning and precise shooting after applying the positioning to a target object.

SUMMARY OF THE INVENTION

In order to solve the above problems effectively, the present invention provides a photoelectric sighting device realizing integration of range-finding unit and multiple sensors and capable of performing 3D positioning to a target object. In the process of sighting, a target object is positioned, and displayed in the same 3D coordinate system together with the sighting device, so as to be sighted.

The invention also provides a calibration method of sighting device, combined with the 3D positioning of a target object by the sighting device, such that a user calibrates a firearm before shooting.

The present invention provides a photoelectric sighting device capable of performing 3D positioning and display of a target object, the sighting device comprises a housing that defines an accommodation space, the accommodation space including a field-of-view obtaining unit, a range-finding unit, a display unit, and a sighting circuit unit, the sighting device being capable of displaying an optical image obtained by the field-of-view obtaining unit on the display unit and precisely predicting an impact point, thereby facilitating the user to calibrate and shoot.

Further, the sighting device also comprises a range-finding unit for measuring the distance from a target object to the sighting device, a sensor unit comprising a three-axis acceleration sensor and a three-axis magnetic field sensor for measuring vertical elevation and horizontal deviation angle of the sighting device respectively, and a positioning unit, which can be a GPS positioning unit, for positioning of the sighting device and acquiring specific longitude and latitude.

Further, in the control unit of the sighting circuit is provided a 3D positioning unit and a 3D image creation unit, the 3D positioning unit creates a 3D coordinate system and an electronic map involving coordinates of the sighting device, through the 3D coordinate system to determine the positions of the sighting device and the target object in 3D coordinates, and through loading the 3D coordinates to the electronic map to acquire the point of the target object on the electronic map and corresponding coordinate values.

Further, the 3D image creation unit creates a 3D image from the 3D electronic map, which is displayed by the display unit and capable of realizing dynamic display.

Further, the field-of-view obtaining unit and the rang-finding unit are fixed within the accommodation space of the housing, the rang-finding unit comprising a signal emitting end and a signal receiving end, the field-of-view obtaining unit comprising an optical image obtaining end, all of the signal emitting end, the signal receiving end, and the optical image obtaining end being disposed at a front end of the housing, the signal emitting end and the signal receiving end are symmetrically distributed at an upper side of the optical image obtaining end, a plane formed by the optical image obtaining end being angled with a vertical side of a gun.

Further, both the signal emission end the signal reception end are projected over the optical image acquisition end; the signal emission end the signal reception end are located at the upper end or lower end of the optical image acquisition end; the front end of the housing is also provided with a protection unit.

Further, the photoelectric sighting device further comprises three field-of-view regulating units (which are key on the display unit, key provided on the housing and key connected to the housing, respectively).

Further, at a read end of the housing is provided the display unit, within the accommodation space of the hosing are provided the sighting circuit unit and a battery assembly (power supply), the field-of-view obtaining unit and the display unit being connected through the sighting circuit unit, the sighting circuit unit comprising a sensor assembly, the sensor assembly comprising a plurality of sensors, such as a wind speed wind direction sensor, a geomagnetic sensor, a temperature sensor, a barometric sensor, a humidity sensor, a vibration sensor, wherein, the three-axis acceleration sensor and three-axis magnetic field sensor are necessary to the photoelectric sighting device in the present invention, and other sensors are optically employed; and the battery assembly supplying power to power units within the photoelectric sighting device.

Further, on the housing is provided a key unit, the key unit comprising an external key assembly and a socket assembly, the external key assembly being provided at a place facilitating the user to use and touch, the socket assembly being connected to the external key assembly through an external connection line, the external key assembly being connected with a secure clip and fixed via the secure clip to a position of a barrel or gun facilitating the user to touch, the key unit being connected onto the sighting circuit unit.

Further, the sighting circuit unit comprises an interface board and a core board, where a field-of-view driving circuit of the field-of-view obtaining unit, a ranging control circuit in the range-finding unit, a key control circuit in the key unit, and a battery control circuit of the battery assembly are all connected onto the core board through the interface board, and a display driving unit of the display unit is connected onto the core board.

Further, the memory card is provided therein with bullet information data base and two ballistic calculation model systems, a user can select the two ballistic models of exterior ballistic six-degree-of-freedom rigidity model or low trajectory ballistic model respectively, according to sensor setting.

Further, the present invention also provides a calibration method for realizing precise shooting in the process of shooting with a sighting device, which is applied in the sighting device in above embodiments, the calibration method comprises: setting an objective target in the field-of-view of the sighting device, measuring to obtain the distance from the sighting device to the objective target through a range-finding unit of the sighting device; calling a horizontal coordinate through a key unit and loading it on a display unit, applying the coordinate center to sight; observing the field of view of the display unit, controlling a gun, to align the coordinate center with the objective target; after aligning, emitting a first bullet to obtain a first impact point on the objective target, allowing the display unit to intercept an image with the first impact point; and adjusting the field of view of display screen of the sighting device, such that the center of the horizontal coordinate is coincident with the first impact point; achieving calibration.

Further, the calibration method may also possibly comprise adding a simulated calibration prior to a first shooting calibration, the simulated calibration simulating an impact point through the ballistic models.

Further, the calibration method may further comprise adding a second shooting calibration after the first shooting calibration, so as to enhance the preciseness of calibration.

In conjunction with the accompanying drawings, features of the present invention will be described in more detail in the following detailed depiction of various embodiments of the present invention.

DETAILED DESCRIPTION OF THE EMBODIMENTS

In order to make the objective, technical solution, and advantages of the present invention more elucidated, the present invention will be described in more detail with reference to the accompanying drawings and embodiments. It should be understood that the preferred embodiments described here are only for explaining the present invention, not for limiting the present invention.

On the contrary, the present invention covers any replacements, modifications, equivalent methods and solutions defined by the claims within the spirit and scope of the present invention. Further, in order to make the public understand better the present invention, some specific detailed portions are elaborated in the following depiction of the details of the present invention.

The invention provides a photoelectric sighting device capable of performing 3D positioning and display of a target object, the sighting device can be mounted on multiple types of sporting gun, such as a rifle, and can also be mounted on a pistol, air gun or other small firearms. When the inventive photoelectric sighting device is mounted on a gun, it is firmly and stably mounted on a mounting rail or a receiving device of the gun through an installer with a known type in the prior art, the installer employed in the present invention can be adapted to mounting rails or receiving devices of different guns, the adaption to different mounting rails or receiving devices are achieved specifically through an adjustment mechanism included on the installer, after the mounting is completed, the sighting device and the gun are calibrated applying calibration method of the gun and gun sight or calibration device.

Figure 1:
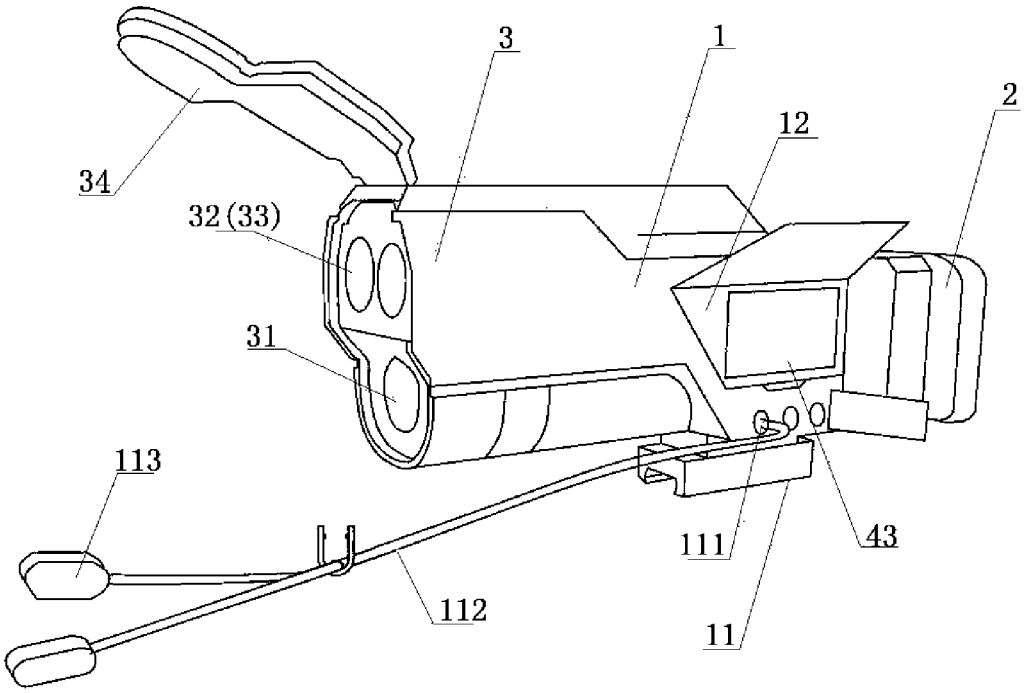
FIG. 1 shows a diagram of external view of a sighting device in an embodiment of the present invention.

FIG. 1 shows a structural diagram of a photoelectric sighting device capable of performing 3D positioning and display of a target object in an embodiment of the present invention, the photoelectric sighting device comprises a housing 1, the external size of the housing 1 determines the size of the entire photoelectric sighting device, while the interior space of the housing 1 determines the size of the interior circuit of the photoelectric sighting device, the front end 3 of the housing 1 is provided with a field-of-view obtaining unit 31, the rear end 2 of the housing 1 is provided with a display unit, the interior of the housing 1 is provided with a sighting circuit unit for connecting the field-of-view obtaining unit 31 and the display unit, the field-of-view obtaining unit 31 can be an integrated image pick-up device for acquiring the image information including a target object within the sighed field of view, the display unit can be a touch display screen for displaying the image information collected by the field-of-view acquisition unit 31 and reticle, the center of the reticle is always in the center position of the display screen of the display unit and it is aligned with the target object in the image information to realize sighting, the sighting circuit unit is provided with a control unit, and the sighting circuit transmits the image information collected by the field-of-view acquisition unit 31 to the display unit for displaying.

The sighting device also comprises a range-finder, a sensor unit and a positioning unit, the range-finder measures the distance from a target object to the sighting device, the sensor unit comprises a three-axis acceleration sensor for measuring vertical elevation of the sighting device and a three-axis magnetic field sensor for measuring the horizontal deviation angle of the sighting device, and the positioning unit, which can be a GPS positioning unit, realizes positioning of the sighting device with specific longitude and latitude. The positioning unit of the present invention is not included in the sensor unit to facilitate understanding of the sensor and positioning unit.

The sighting circuit unit is connected with a memory card provided therein with a mother library of 3D electronic map; the control unit of the sighting circuit is provided with a 3D positioning unit and a 3D image creation unit, the 3D positioning unit positions a target object in a 3D coordinate system, and displays and marks the target object and the sighting device in the 3D coordinate system, the 3D positioning of the target object is achieved by calling the mother library of 3D electronic map in the memory card to create a 3D electronic map of the area where the photoelectric sighting device is located, and loading the 3D coordinate system on the 3D electronic map; the 3D image creation unit generates an image from the created 3D electronic map with the target object and the sighting device, and the image is displayed on the display unit to facilitate user's watching and utilization, such that the best shooting position can be visually found in the image.

Figure 2:
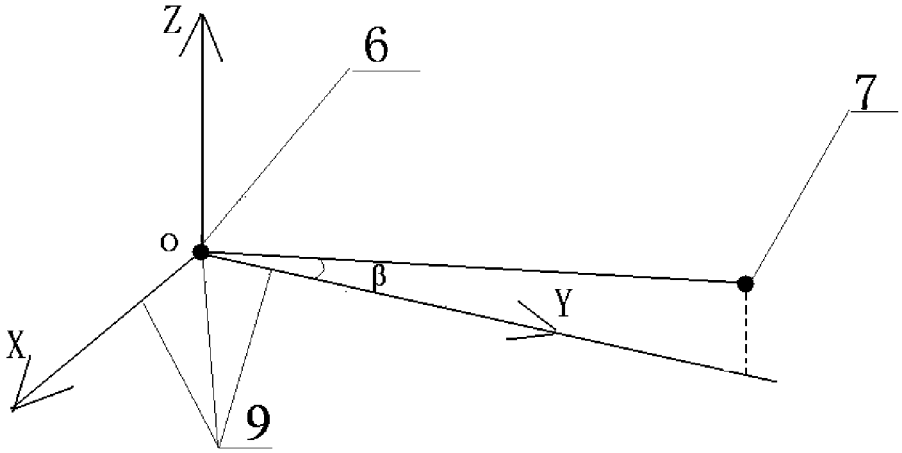
FIG. 2 shows a diagram of creating an O-XYZ 3D coordinate system by a 3D positioning unit in the sighting device in an embodiment of the present invention.

As shown in FIG. 2, the 3D positioning unit creates an O-XYZ 3D coordinate system 9, the center point of which is the center O of the field-of-view acquisition end of the field-of-view obtaining unit, the Z axis direction of the 3D coordinate system is parallel to the gravity direction, with the direction departing from the center of the earth as the positive direction; the Y axis direction of the 3D coordinate system is perpendicular to the gravity direction, in the same plane with the sighting direction of the field-of-view obtaining unit of the sighting device, and with the direction along the sighted direction of the field-of-view obtaining unit of the sighting device as the positive direction; the X axis direction of the 3D coordinate system is perpendicular to the O-YZ plane, and a direction can be determined as the positive direction of X axis as long as the direction meets the right-hand rule.

The following is sighting, a target object 7 is determined in the process of sighting, a distance L from the target object to the sighting device is obtained through the range-finder of the sighting device 6, a horizontal deviation angle $\alpha$ and a vertical elevation $\beta$ of the sighting device 6 are obtained through the three-axis acceleration sensor and the three-axis magnetic field sensor of the sighting device 6, the vertical elevation $\beta$ is an elevation relative to the O-YZ plane in the O-XYZ 3D coordinate system, and through the above distance L, horizontal deviation angle $\alpha$ and vertical elevation $\beta$, the coordinate of target object 7 is determined as $(0, L\cos\beta, L\sin\beta)$.

Figure 3:
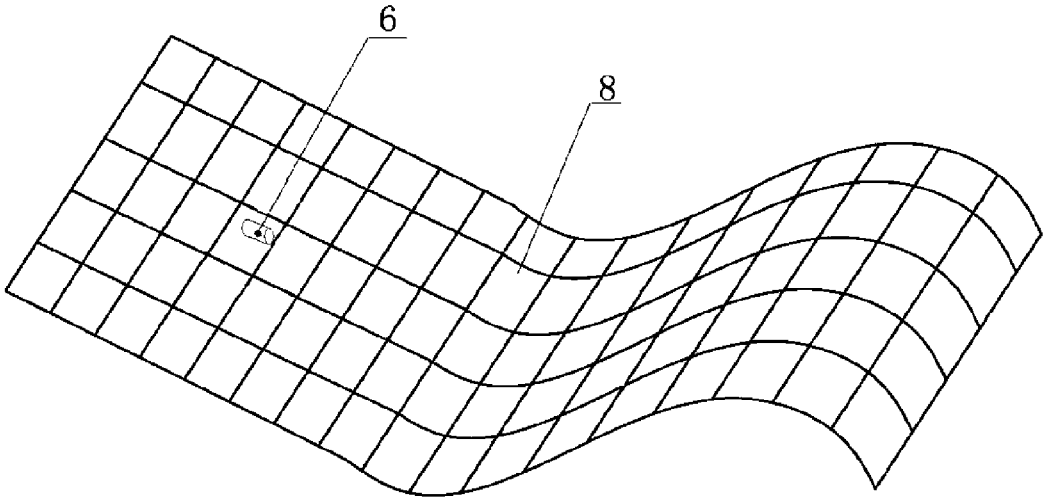
FIG. 3 shows a diagram of a 3D electronic map created by a 3D positioning unit in the sighting device in an embodiment of the present invention.
Figure 4:
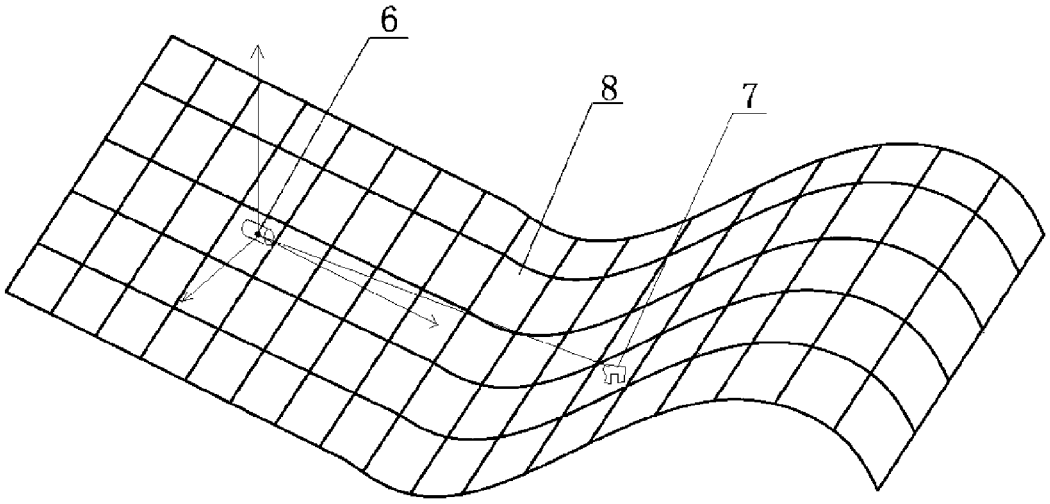
FIG. 4 shows a diagram of a 3D electronic map superposed with an O-XYZ 3D coordinate system in an embodiment of the present invention.

As shown in FIGS. 3 and 4, the 3D positioning unit acquires the position information of the sighting device 6 measured by the positioning unit, specifically corresponding longitude and latitude $(N_1,E_1)$, while calling the scene data at the longitude and latitude $(N_1,E_1)$ in the mother library of the 3D electronic map, to obtain a 3D electronic map after combination and compaction processing; the 3D positioning of target object 7 is achieved by marking $O_1$ on the 3D electronic map 8 for the position $(N_1,E_1)$ of the electronic sighting device 6, loading the point O of O-XYZ 3D coordinate system 9 to be coincide with $O_1$ on the 3D electronic map 8, rotating the O-XYZ 3D coordinate system 9 according to the horizontal deviation angle $\alpha$ to make the coordinate of target object 7 positioned at the point I on the 3D electronic map, and acquiring the longitude and latitude $(N_2,E_2)$ of the point I through the 3D electronic map 8; the target object 7 has not only the longitude and latitude values but also a relative height value $L\sin\beta$ relative to the sighting device 6, as a result, the detailed position information of the target object 7 can be displayed completely, to facilitate user's utilization and realize assistant shooting, while the sighting device can also display the detailed position information of itself.

Wherein, the above mother library of 3D electronic map includes scene data of corresponding areas therein, the production of the scene data comprises the following steps:

1, making an aviation-photographed picture or a satellite-photographed picture into a scene image in a large scale of 1:1000 meter scale;

2, using the center of a city near the user's location as a relative height base point, and setting the height value as 0 m;

3, with the relative height base point as the origin, in field surveying and mapping operation manner, collecting the terrain structure of the scene, the height, length and width of the terrain structure, and relative height of the terrain structure relative to relative height base point, and generating relative height value sequence array, in which every height value is a relative height at a collection point;

the operation interval length of field collection surveying and mapping is 100 m -1000 m, and can be practically adjusted according to specific circumstances.

4, storing the scene data including the relative height values and three latitudes in the mother library of 3D electronic map;

wherein the three latitudes are height, length and width of the terrain structure, and the relative height is the relative height between the base of the terrain structure and the base point.

The 3D image creation unit creates a 3D image from the acquired model of the 3D electronic map 8 which is capable of realizing dynamic display and displayed by the display unit, and the creation of 3D image capable of realizing dynamic display by the 3D image creation unit comprises the following steps:

1, performing parameterization setting to the 3D electronic map, specifically, marking a corresponding spatial coordinate on every point of the 3D electronic map, to achieve conversion of entire 3D electronic map model into representation of parameters with coordinate dynamic attribute;

2, setting a rotation axis with angle dynamic attribute to the 3D electronic map;

3, displaying the 3D electronic map after parameterization setting, automatically identifying the set parameters, analyzing parameters and displaying the dynamic attribute, and correlating with an external driving source for driving the 3D electronic map to dynamically display; wherein, the external driving source specifically can be an interface-standard dynamic link library in accordance with definition of a display identification module, the dynamic link library in the embodiment is correlated with the touch display screen, the dynamic attribute is provided with a correlation interface, which allows identifiable variable provided by the display unit to be correlated with the dynamic attribute by selecting correlation-required driving source and variable under the driving source; specifically, a user touches the display unit to generate a variable, and the 3D electronic map rotates or performs other dynamic changes according to the variable;

4, driving the 3D electronic map to dynamically change with the change of data of the external driving source, specifically, operating a touch display screen to realize dynamic change operation of the 3D electronic map through the dynamic link library to achieve dynamic display.

Figure 5:
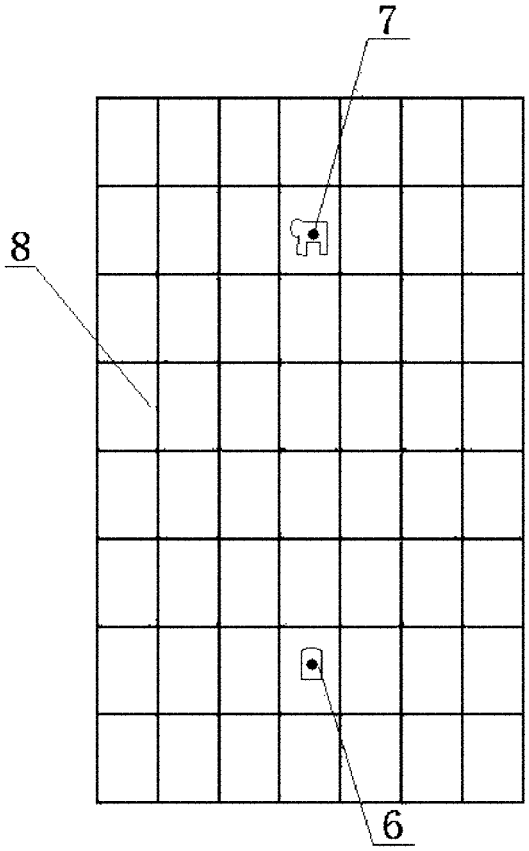
FIG. 5 shows a top view of a 3D electronic map superposed with an O-XYZ 3D coordinate system in an embodiment of the present invention.
Figure 6:
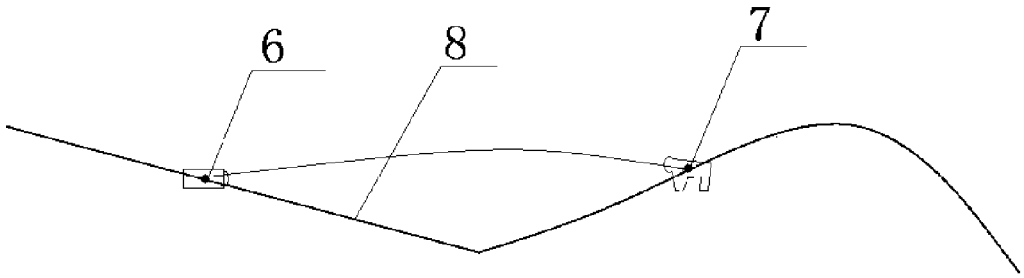
FIG. 6 shows a side view of a 3D electronic map superposed with an O-XYZ 3D coordinate system in an embodiment of the present invention.

As shown in FIGS. 5 and 6, the 3D image creation unit displays the 3D electronic map dynamically on the display unit, and the user can rotates the displayed 3D electronic map through the display unit, which benefits user's observation of entire field and environment for sighting and shooting, and in case of disadvantageous shooting position and environment, according to the dynamically displayed 3D electronic map, it helps to search an favorable shooting position and improve comfort degree of shooting, further to improve shooting precision, and has great advantage for improving success rate of shooting by comprehensive observing entire shooting field.

The invention firstly creates 3D coordinate with respect to the sighting device and displays a target object in the 3D coordinate, then creates an electronic map (the sighting device and the target object are on the electronic map), and superposes the 3D coordinate of the sighting device with the electronic map, so as to display the target object on the electronic map which also includes terrain. Based on the above technical solution, the present invention can realize simultaneous display of the sighting device and the target object on one map, and rapidly creating of a map to make the terrain of the entire shooting area known to users, while it can present the positions of the shooter and target object in a new viewing angle, namely a new observing and analyzing angle, such that the user can regulate the shooting solution in time.

In one embodiment, the lens zoom multiple of the field-of-view obtaining unit can be selectively varied based on actual applications; the integrated video camera as employed in the present invention is 3-18X video camera made by Sony, but not limited to the above model and zoom multiple. The integrated video camera is disposed at the foremost end of the photoelectric sighting device; meanwhile the front end of the integral camera is equipped with a UV lens and a lens cap 34. The lens cap 34 may perform a 270° flip to fully cover the front end of the housing, which protects the field-of-view obtaining unit from not being hurt, protects the lens and facilitates cleaning.

The range-finder is a laser range-finder. The range-finder is located within the housing 1. The laser range-finder is a pulse-type laser range-finder. The ranging principle of the pulse-type laser range-finder is first finding the time needed for a round trip of the laser as to the to-be-measured distance, and then calculating the to-be-measured distance through the following equation using this time:

$$L=ct/2$$

In the expression, L denotes the to-be-measured distance, c denotes a light velocity, while t denotes flying time of the laser.

Figure 7:
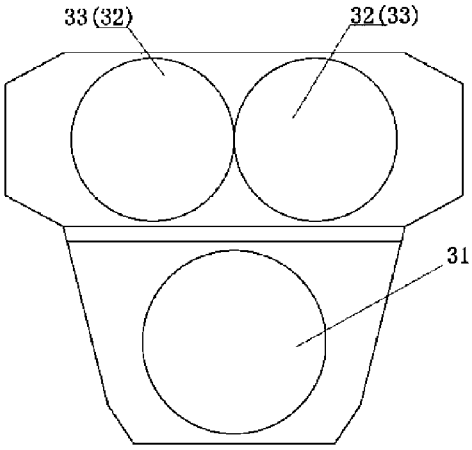
FIG. 7 shows a diagram of a front end of a housing of a sighting device in an embodiment of the present invention.

As shown in FIG. 7, the laser range-finder comprises a laser emitting end 32 and a laser receiving end 33. Both the laser emitting end 32 and laser receiving end 33 are disposed at a front end of the housing 1 and symmetrically distributed above the camera of the integrated video camera. The laser emitting end 32, laser receiving end 33, and the camera of the integrated video camera form an equilateral inverted triangle or an isosceles inverted triangle. Both the laser emitting end 32 and the laser receiving end 33 project above the front end of the housing 1, and the laser emitting end 32 and the laser receiving end 33 have a certain height difference over the field-of-view obtaining unit 31; moreover, the laser emitting end 32 and the laser receiving end 33 project above the housing front end 3. Such design narrows the housing internal space occupied by the laser range-finder. By projecting the extra-long portions of the laser emitting end 32 and the laser receiving end 33 outside of the housing front end 3, a high integration of the internal space of housing 1 is realized, such that the electrical-optic sighting device becomes more miniaturized, more flexible, and more portable; additionally, because the thickness of the object lens of a common field-of-view obtaining unit is higher than the thickness of the lens of the laser emitting end and receiving end, this design may reduce the laser range-finding error.

The lens cap 34 as mentioned in the above embodiment may cover the field-of-view obtaining unit as well as the front end of the laser range-finder, so as to protect the laser range-finder from being damaged.

Figure 8:
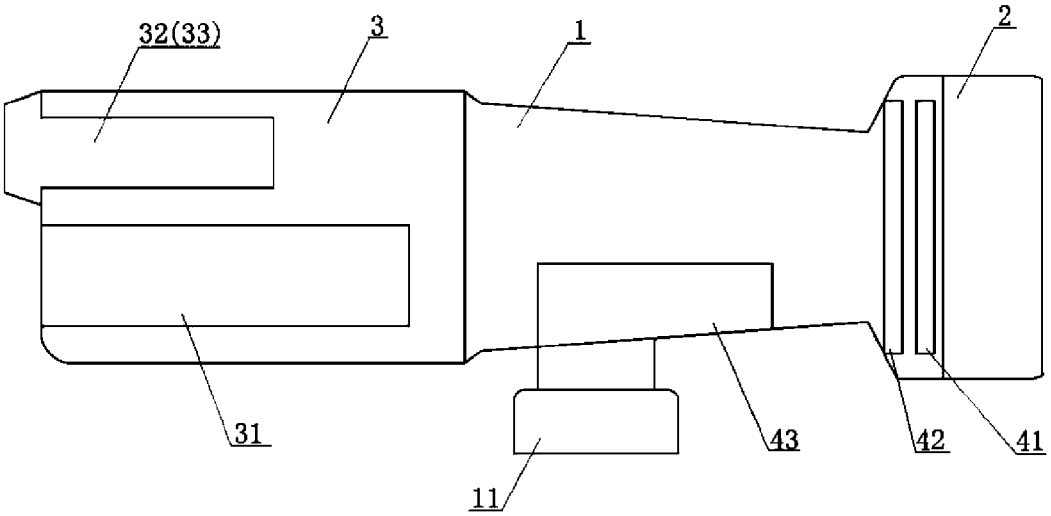
FIG. 8 shows a structural sectional view of a sighting device in an embodiment of the present invention.

As shown in FIG. 8, the sighting circuit unit disposed within the housing 1 for connecting the field-of-view obtaining unit 31 and the display unit comprises a CPU core board 41 and an interface board 42. The interface board 42 is connected to the CPU core board 41. Specifically, the input and output of the CPU core board 41 are connected through a serial port at a bottom side of the interface board 42, and the CPU core board 41 is disposed at one side of the display unit display screen relative to the inside of the housing 1. The interface board 42 is disposed at one side of the CPU core board 41 opposite to the display screen. The display screen, CPU core board 41, and the interface board 42 are disposed parallel to each other. The integrated video camera and the range-finder are connected to the interface board 42 through a wiring. The image information obtained by the integrated video camera and the distance information obtained by the range-finder are transmitted to the CPU core board 41 through the socket board 42, and then the information is displayed on the display screen via the CPU core board 41.

CPU core board 41 is provided therein with the 3D positioning unit and 3D image creation unit.

The CPU core board 41 may be connected to a memory card via the interface board 42 or directly connected to the memory card. In the embodiments of the present invention, a memory card slot is provided at a top position of the CPU core board 41. The memory card is plugged into the memory card slot. The memory card may store information. The stored information may be provided to the CPU core board 41 for calculation of a ballistic equation. The memory card may also store feedback information transmitted by the CPU core board 41.

A USB interface is also provided at the memory card slot edge side at the top of the CPU core board 41. Through the USB interface, information from the CPU core board 41 may be outputted, or the software program disposed within the CPU core board 41 may be upgraded and optimized.

Within the housing 1 is also disposed a battery compartment 12. Within the battery compartment 12 is provided a battery assembly 43, within the battery compartment 12 is provided a slideway for plugging the battery assembly 43 in and out. The battery compartment 12 is disposed at a middle bottom side within the housing 1. Through a side edge of the housing 1, a battery compartment cover may be opened to change the battery assembly 43. In order to prevent slight deviation in battery size of the same model, a layer of sponge (or foam, bubble cotton) is provided at the internal side of the battery compartment cover. The sponge structure disposed at the internal side of the battery compartment cover may also prevent battery instability caused by shock from gun shooting. A battery circuit board is provided at an upper side of the battery assembly 43. The battery assembly 43 supplies power to various elements of the photoelectric sighting device through the battery circuit board, and meanwhile the battery circuit board is connected to the CPU core board 41 via the interface board 42. In one embodiment, the battery assembly 43 specifically employs a voltage of 7.2-7.4V; a capacity of 3900-5700 mAh; an electrical work of 28.08 Wh-42.2 Wh; and a weight of 100-152 g.

Figure 9:
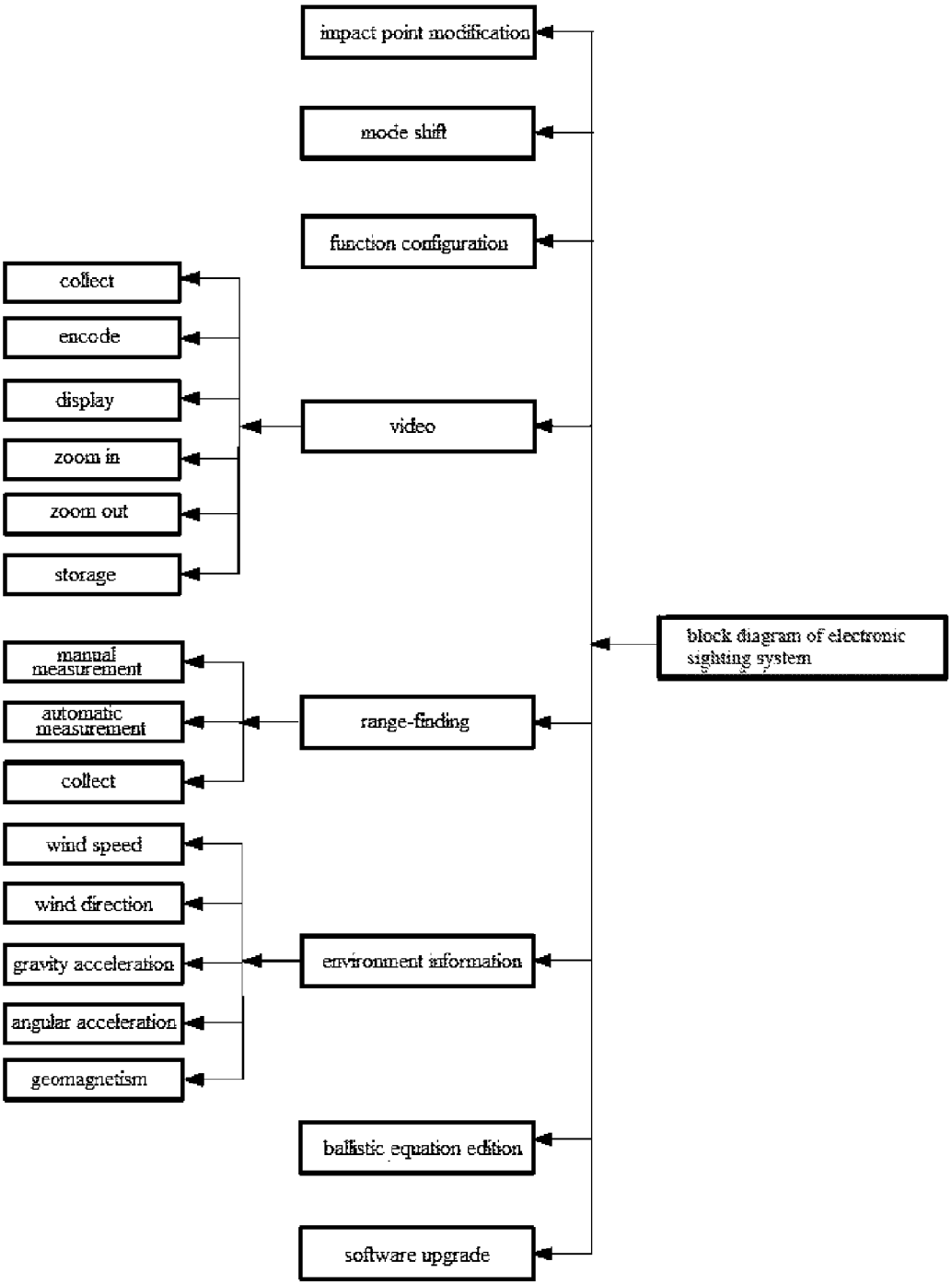
FIG. 9 shows a system block diagram of a sighting device in an embodiment of the present invention.
Figure 10:
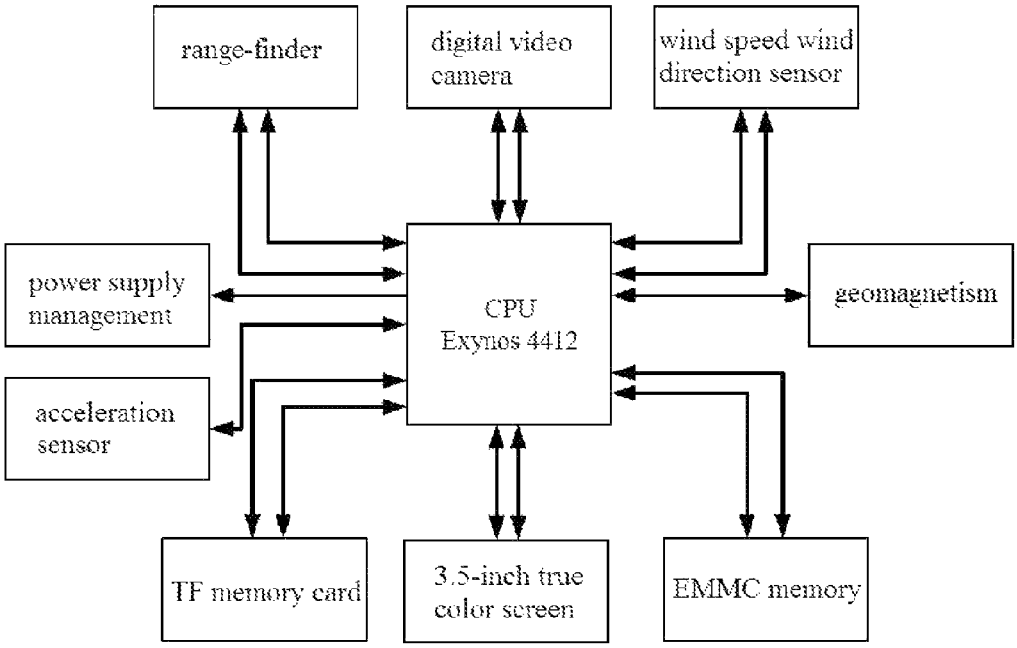
FIG. 10 shows a structural diagram of a sensor unit of a sighting device in an embodiment of the present invention.

As shown in FIGS. 9 and 10, the sensor unit also comprises a group of other sensors besides the three-axis acceleration sensor and three-axis magnetic field sensor, which includes all of or a combination of several of a wind speed and direction sensor, an air pressure sensor and a humidity sensor (acquiring different sensor data according to selected ballistic equations), wherein, the three-axis acceleration sensor and three-axis magnetic field sensor are necessary to the photoelectric sighting device in the present invention, and other sensors are optically employed. In one embodiment, a geomagnetic sensor of triaxial magnetometer MAG3110 is integrated on the CPU core board 41, the wind speed and direction sensor is externally disposed on the photoelectric sighting device and connected on the interface board 42, others of temperature sensor, air pressure sensor and humidity sensor can be integrated on the CPU core board 41 or connected on the CPU core board via the interface board 42, all the above sensors adopt IIC (or I2C, $I^2C$) interfaces.

An external key is provided at the external side of the housing 1 close to the display unit. The external key is connected on the socket board 42 via a key control board at the internal side of the housing 1. By touching and pressing the external key, the information on the display unit may be controlled, selected and modified. The specific position of the external key is 5-10 cm away from the display unit.

The external key is specifically disposed to the right of the display unit. However, the specific position of the external key is not limited to the above position. Instead, it should be disposed at a position facilitating the user to use and press. The user controls the CPU core board 41 through the external key. The CPU core board 41 drives the display screen to display. The external key may control selection of a shooting target in a view zone displayed on the display unit, or control the photoelectric sighting device to start a laser range-finder, or control a video camera unit of the photoelectric sighting device to regulate the focal distance of the gun sight, etc.

In another embodiment, the key control board for the external key may be provided with a wireless connection unit, through which peripheral devices are connected. The periphery devices include a smart phone, a tablet computer, etc. then, program is loaded through the periphery devices, which may control selection of a shooting target in a view zone displayed on the display unit, or control the photoelectric sighting device to start a laser range-finder, or control a video camera unit of the photoelectric sighting device to regulate the focal distance of the gun sight, etc.

At the external side of the housing 1 is further provided an external slot 111. A portion of the external slot 111 disposed at the internal side of the housing is connected to the key control board. A portion of the external slot 111 disposed at the external side of the housing is connected to an external connection line 112. The external connection line 112 is connected to an external key 113 through which the user may control selection of a shooting target in a view zone displayed on the display unit, or control the photoelectric sighting device to start a laser range-finder, or control a video camera unit of the photoelectric sighting device to regulate the focal distance of the gun sight, etc.

The external connection line 112 may also be connected to other operating devices, or ancillary shooting devices, or video display devices; or information and video may be transmitted through the external connection line 112. All of the other operating devices comprise an external control key, a smart phone, a tablet computer, etc. One end of the external connection line 112 is socketed within the external socket slot 111; the other end is provided with a "U"-shaped clip. The external connection line 112 is clipped on the gun barrel through the "U"-shaped clip, thereby securing the external connection line 112 and preventing affecting shooting. In one embodiment, an operating device connected through the external connecting line 112 may select a target in the view zone, start a laser range-finder, or adjust a gun sight focal distance, etc.; the "U"-shaped clip provide simple and convenient zooming and focusing operations for a gun without a support.

The display unit is a LCD display. A touch operation may be implemented on the LCD display. The size of the display may be determined based on the actual needs. In the present invention, the display screen as adopted is sized to 3.5 inches. In one embodiment, the LCD display screen has a resolution of 320*480, the work temperature is −20±te° C., the backlight voltage is 3.3 v, and the voltage between the LCD screen and the GPU interface is 1.8 v; the touch screen is a capacitive touch screen.

Figure 11:
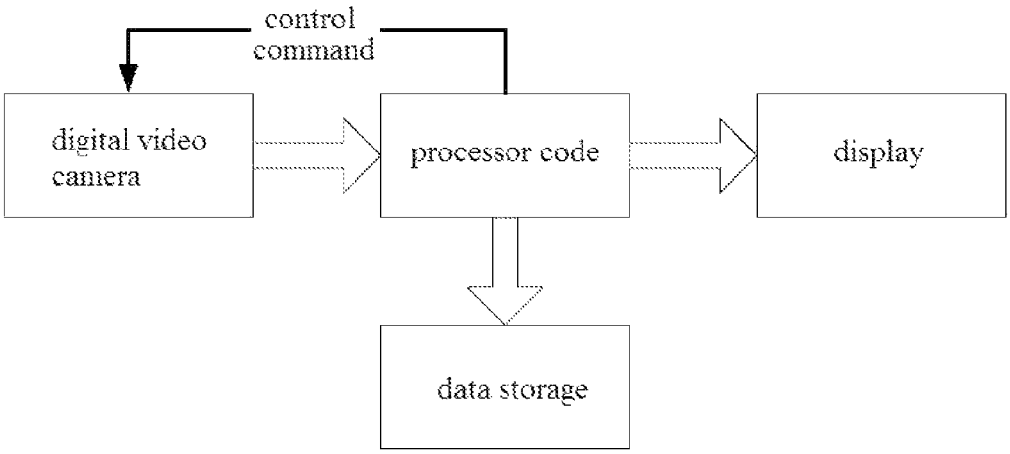
FIG. 11 shows a system diagram of field-of-view acquisition, storage, and feedback control of a sighting device in an embodiment of the present invention.

As shown in FIG. 11, the reticle (front sight) displayed on the display screen and the video information collected by the field-of-sight obtaining unit are superimposed. The reticle is for sighting and shooting, while the display screen also displays ancillary shooting information for facilitating shooting and transmitted by various sensors above and work indication information; the ancillary shooting information includes environment information, distance information, and angle information; the environment information includes wind speed data, temperature data, barometer data, and magnetic field data. The wind speed data is disposed at one end of the upper side of the display screen. The magnetic field data is disposed at a middle part of the lower side of the display screen. The temperature data and barometric data are disposed at the other end of the upper side of the display screen; the distance information is disposed above the temperature data and barometric data; the angle information includes the elevation angle data and azimuth angle data, where the elevation angle data is disposed beneath the wind speed data, while the azimuth angle data is disposed in the middle part of the upper side of the display screen; The work indication information comprises battery level information, wireless signal information, remaining recording time, multiple information, shift key, and menu key; the battery level information is disposed beneath the elevation angle data, while the remaining recording time, multiple information, and wireless signal information are disposed successively beneath the temperature data; the shift key and menu key are disposed at two ends of the lower side of the display screen.

The ancillary shooting information in the above embodiments are partially applied in a ballistic equation, and partially used for displaying to alert the user. The photoelectric sighting device may also possibly comprise one or more ports and a radio transceiving unit. The one or more ports and radio transceiving unit may communicate with a smart phone or other terminal devices through a wired or wireless connection.

The other information includes Wi-Fi signal, battery, state shift key, menu key, remaining recording time, recording key, and current multiples. The LCD display screen provided by the present invention may perform shift between daylight/night work modes. The night work mode is implemented through infrared light compensation.

The photoelectric sighting device may also comprise a wireless transmission module. The wireless transmission module is connected to an external device through a wireless connection manner. The wireless transmission module will synchronously display the reticle, image and information displayed on the display screen to the external device; the wireless connection manner is a WiFi connection or other wireless network connection, but not limited to these connection manners. The external device is a smart phone or other intelligent terminal device, etc.

Based on the structure of the above photoelectric sighting device, its CPU core board 41 is further connected with a memory card. Within the memory card, bullet information database and two ballistic calculation model systems are set. The user may select one of the two ballistic models based on the setting of the sensor. The ballistic models are an external ballistic 6-degree-of-freedom rigidity model and a low trajectory ballistic model, respectively. Through the two ballistic models, the photoelectric sighting device realizes a precise positioning.

In order to accurately predict the position of an impact point, the impact point is predicted using an external ballistic 6-degree-of-freedom rigidity model based on the data collected by various sensors and the bulletin data stored in the memory.

When a shot is flying in the air, the force and torque acting on the shot are mainly the acting force from the earth and aerodynamic force. Generally, the motion of the shot may be decomposed into center of mass motion and motion around the center of mass, which are described by momentum lar and law of moment of momentum.

In the 6-degree-of-freedom rigidity model, the shot in spatial movement is regarded as a rigidity. It considers three free degrees of the center of mass of the shot and three free degrees rotating around the center of mass. And all forces and torques acted on the shot are considered.

In the above model, the parameters that need to be input include: 1) atmospheric conditions: wind speed wind direction, temperature, air pressure, humidity; 2) shooting position: altitude and latitude, as well as elevation coordinates of the shooting point; 3) shooting condition: initial velocity and direction of the bullet outlet, wherein the direction is represented by the elevation angle and azimuth angle of the gun barrel; 3) bullet-target distance: obtained through a laser range-finder; 4) bullet data (stored in the database): mass of the shot, cross-section area of the shot, mass eccentricity (or rotational inertia), resistance coefficient, etc.

Figure 12:
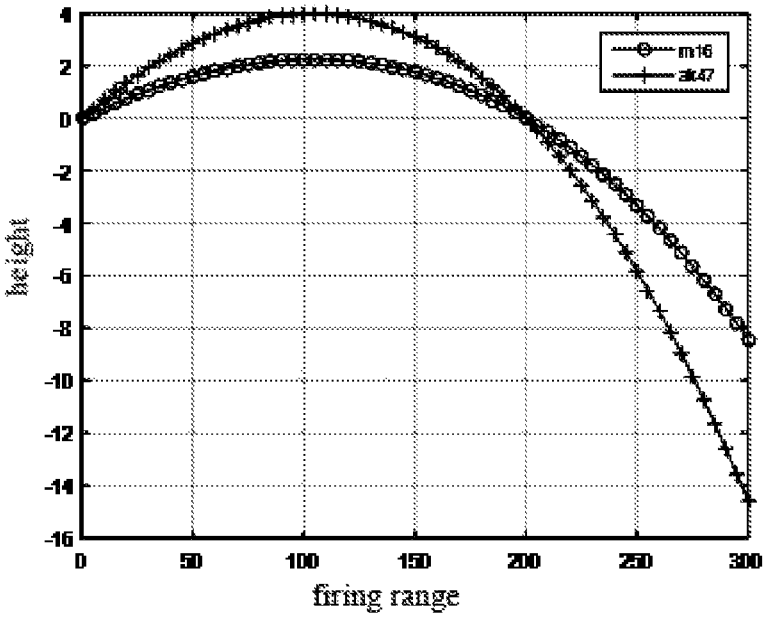
FIG. 12 shows a ballistic simulation comparison diagram for two types of bullets by a sighting device in an embodiment of the present invention applying an external ballistic 6-degree-of-freedom rigidity model.
Figure 13:
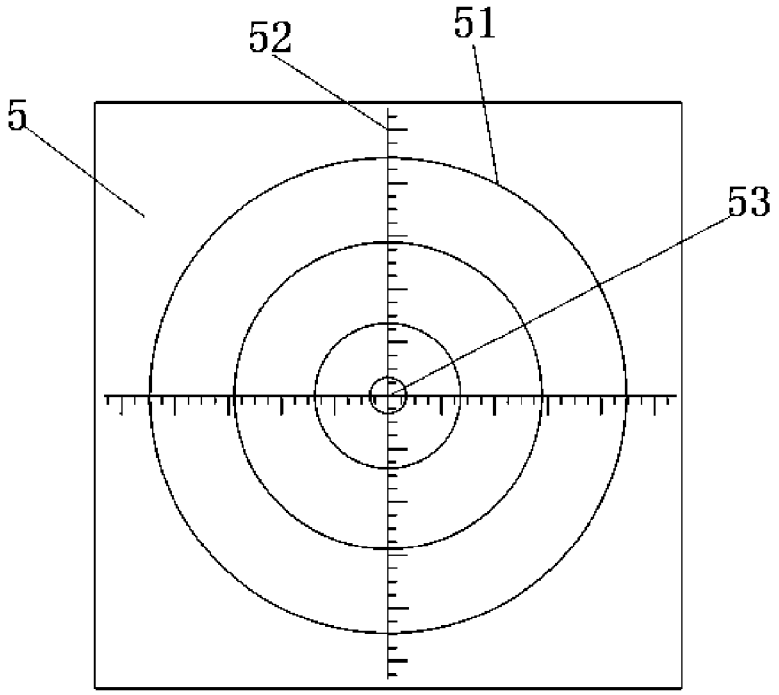
FIG. 13 shows a schematic diagram of a display screen before calibration in a calibration method of sighting device in an embodiment of the present invention.
Figure 14:
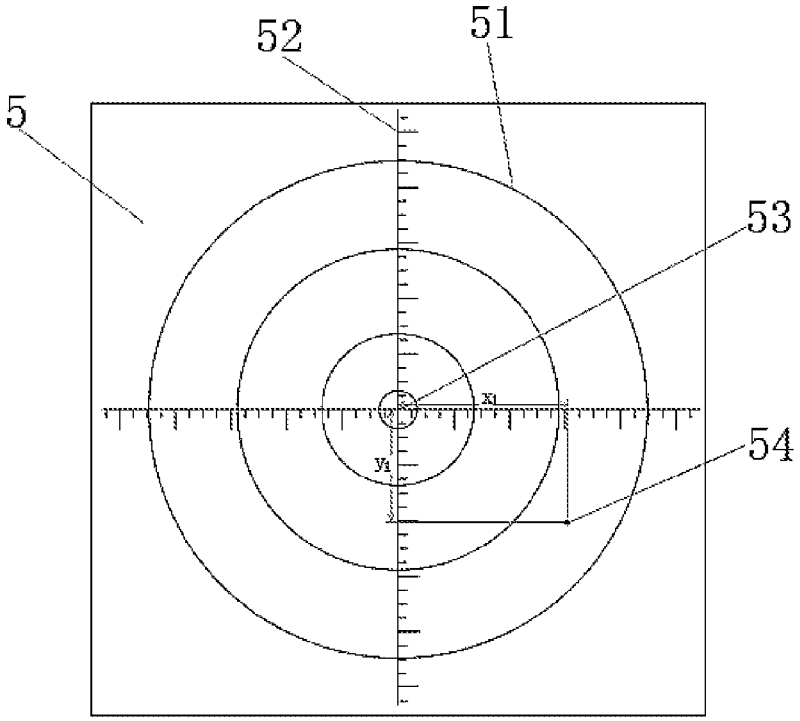
FIG. 14 shows a schematic diagram of a display screen with a first impact point in a calibration method of sighting device in an embodiment of the present invention.
Figure 15:
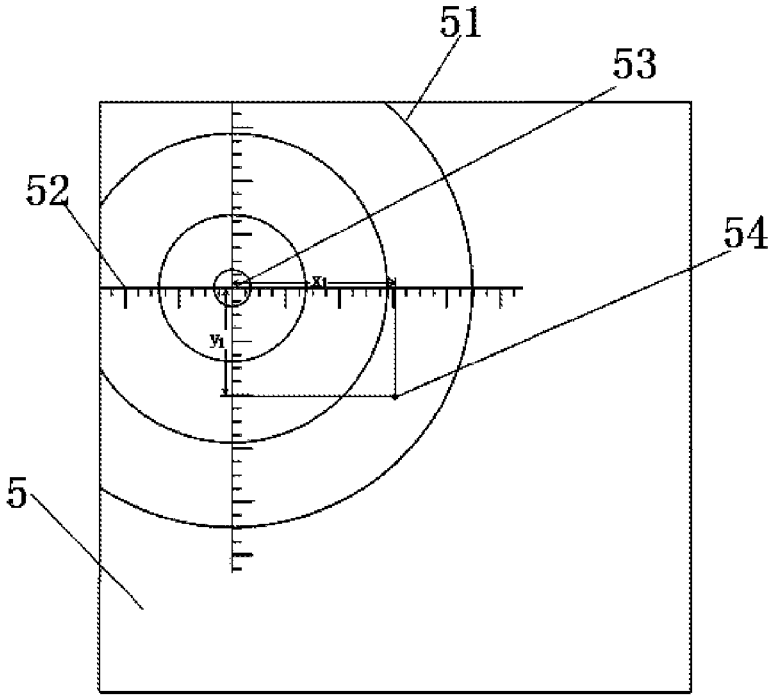
FIG. 15 shows a local enlarged view of FIG. 14 in an embodiment of the present invention.
Figure 16:
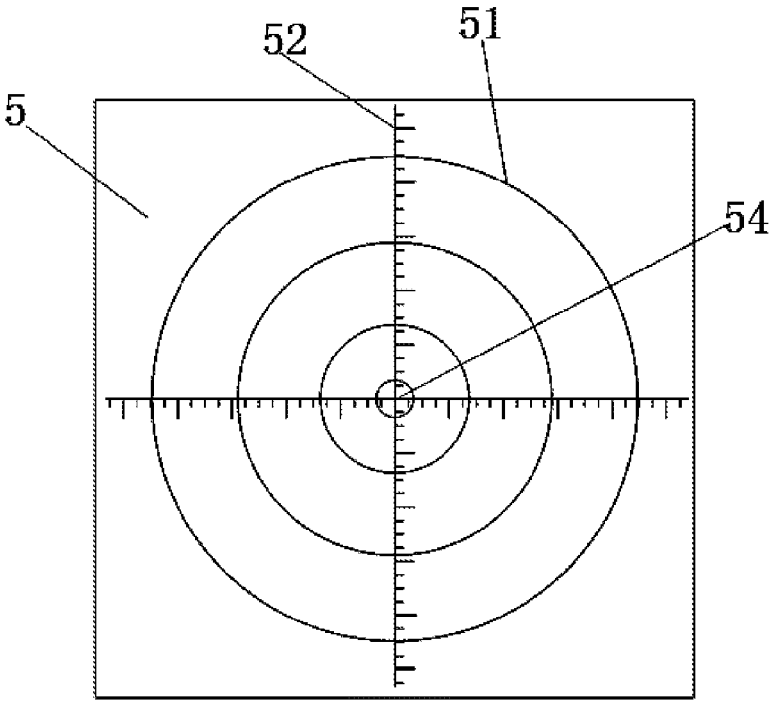
FIG. 16 shows a schematic diagram of a display screen after calibration for a first shooting in a calibration method of sighting device in an embodiment of the present invention.

FIG. 12 illustrates simulated calculations for a M16 233 Rem, 55g, PSP shot and an AK47 (7.62×39 mm), 125g, PSP shot. The simulation is performed only to vertical direction, and lateral direction is temporarily omitted. Supposed environment conditions: bullet-target distance 200 m, launching height 0.001 m, height 500 m, temperature 50 Fahrenheit degrees. It is seen from the figure that in order to shoot targets of a same distance, both initial launching heights are different; based on restriction conditions measured according to weather, the required launching height and launching direction are resolved; they may be regulated to hit a target at a certain distance.

In another scenario, if the wind force and wind speed are not high and the acting force of the lateral wind is very small, the low trajectory ballistic model is employed. In the low trajectory ballistic model, impacts from the low wind speed wind direction, temperature, air pressure, humidity might not be considered.

The low trajectory may be understood such that the arc variation of the bullet trajectory (i.e., parabola) approaches to a straight line. The closer to the straight line, the lower trajectory it is. Low trajectory ballistic calculation refers to ballistic calculation under a condition of small angle of fire; based on the feature that the resistance coefficient of a low-speed shot approximates a constant (specifically, for a low trajectory, under a standard weather condition, the air density function is approximately 1, the sound velocity is regarded as a constant; therefore, the resistance coefficient is a function of the bullet speed), external ballistic 6-degree-of-freedom basic equation may be simplified to resolve an equation of shooting elements of any point of the low-speed low trajectory, thereby finding a calculation method for resolving the shooting elements at the apex of the trajectory, the shooting elements at the impact point, and the point-blank range.

During the shooting process, some affecting objects (e.g., grass blown by wind) might exist to block the targeted object, thereby affecting the accuracy of the obtained range data. Therefore, in one embodiment, the laser range-finder of the photoelectric sighting device likely have a manual mode. The manual mode is specifically selecting a to-be-ranged target object on the display unit. The display unit feeds back the target object to the control unit. The control unit sets a flag to the target object and controls the laser range-finder to range the flagged target object. Only the range value of the flagged target object is read. Through the above manual ranging, the range value of the sighted object can be accurately measured, which avoids interference from other affecting objects. The control unit in the present embodiment is a CPU core board, or other unit or assembly that has an independent data processing capability.

The present invention further provides a calibration method for a—photoelectric sighting device so as to realize accurate shooting during a shooting process; the calibration method is applied to an photoelectric sighting device in the above embodiments. The calibration method comprises an automatic simulated calibration and a manual calibration.

The automatic simulated calibration comprises steps of:

1. setting a target within a field of view of the photoelectric sighting device;

2. simulating a simulated impact point through one of the above ballistic models;

In the case of applying the external ballistic 6-degree-of-freedom rigidity model to simulate the impact point, collecting information of the range-finder, environment information and angle information of a plurality of sensors, bullet-related data stored in a memory card, thereby simulating the impact point;

In the case of applying the low trajectory ballistic model to simulate the impact point, under a standard weather condition, the air density constant is 1, the sound speed is a constant, the resistance coefficient is a function of bullet speed, thereby simulating the impact point;

3. watching the field of view of a display screen of the photoelectric sighting device, adjusting the reticle, and making the reticle on the display screen in coincidence with the simulated impact point;

4. accomplishing automatic simulation and calibration.

As shown in FIGS. 13-16, the manual calibration comprises steps of:

1. setting a target 51 within a field of view 5 of the photoelectric sighting device, and measuring a distance from the photoelectric sighting device to the target 51 through a laser range-finder of the photoelectric sighting device;

2. invoking a plane coordinate 52 through an external key, loading the plane coordinate 52 on the display screen, a coordinate center 53 of the plane coordinate 52 coinciding with a reticle center;

3. watching the field of view 5 of the display screen of the photoelectric sighting device, and making the coordinate center 53 of the plane coordinate 52 in alignment and coincidence with the target within the field of view;

4. after alignment and coincidence, shooting a first bullet, and obtaining a first impact point 54 on the target, the display screen print-screening an image of the first impact point 54;

5. recording values of horizontal coordinate and longitudinal coordinate of the first impact point in the plane coordinate, e.g., $x_1$, $y_1$, and regulating the field of view of the display screen of the photoelectric sighting device; moving the horizontal coordinate direction by $-x_1$; moving the longitudinal coordinate direction by $-y_1$, such that the coordinate center 53 of the plane coordinate 52 coincides with the first impact point;

6. accomplishing calibration.

Before the first calibration shooting in the above embodiment, it always occurs that the first shooting deviates greatly, and the impact point does not fall within the target in the field of view. In order to avoid occurrence of the above condition, it is proposed in one embodiment of the present invention that through a ballistic model in the above embodiment, performing simulated shooting to the target in the field of view in step 1 to find a simulated impact point; then, performing automatic simulation and calibration based on the simulated impact point; then possibly selecting the first shooting calibration. This may guarantee that the impact point of the first shooting falls on the target.

According to the calibration method provided in the present embodiment, the core controller real-time receives the environment values collected by sensors, the distance from the gun sight to the sighted object measured by the laser range-finder, and bullet information provided by the memory. The ballistic model calculates a ballistic curve of the bullet based on the real-time varied environment values, consecutive non-discrete distance information, and bullet information, thereby obtaining a simulated impact point, and real-time applies the calculated impact point to determine and regulate a reticle, such that when the photoelectric sighting device sights any sighted object at a consecutive non-discrete distance under any environment, the reticle can be regulated in real time based on a ballistic curve calculation model, such that the reticle center is close to the actual impact point, thereby achieving an effect of non-polar reticle.

In one embodiment, after the first calibration shooting is completed, in order to further enhance the preciseness, a second shooting calibration may be performed, comprising steps of:

Steps 1-5 are identical to the above embodiment, thereby omitted here;

6. performing a second shooting to shoot a second bullet, obtaining a second impact point on the target, the display screen print-screening an image having the first impact point and the second impact point;

7. recording the numerical values of the horizontal coordinate and longitudinal coordinate of second impact point in the plane coordinate, e.g., $x_2$, $y_2$, and regulating the field of view of the display screen of the photoelectric sighting device; moving the horizontal coordinate direction by $-x_2$; moving the longitudinal coordinate direction by $-y_2$, such that the center of the plane coordinate coincides with the first impact point;

8. accomplishing calibration.

In one embodiment, the display screen print-screens an image by obtaining an instruction signal transmitted from the CPU core board, the memory card caches vibration parameters generated when a plurality of guns of various models shoot bullets. The vibration parameters may include: a vibration frequency, a vibration amplitude, and a vibration duration. The CPU core board may be connected to a sensor obtaining a vibration parameter. The sensor is a vibration sensor of a known technical kind. The obtained vibration parameters are matched with vibration parameters cached in the memory card. In the case of a successful match, it is confirmed as a shooting vibration; then the core control board sends a snapshot instruction signal to the display screen to control the display screen to snapshot.

The calibration method provided by the present invention realizes accurate calibration under the current environment values by making the reticle in coincidence with the impact point through specific shooting. The calibration method can be used in combination with the photoelectric sighting device for 3D positioning in the present invention.

The invention claimed is:

1. A photoelectric sighting device capable of performing 3D positioning and display of a target object, comprising:

a field-of-view obtaining unit for acquiring image information within a sighted field of view;

a sighting circuit unit, for transferring the image information from the field-of-view obtaining unit to a display unit, and creating an electronic map with both of the photoelectric sighting device and a target object, and transmitting the electronic map to the display unit for dynamic display;

a display unit, for displaying the reticle and the image information acquired by the field-of-view obtaining unit and the electronic map;

a power supply, for supplying power to the photoelectric sighting device;

a range-finding unit, for measuring a distance from the target object to the photoelectric sighting device;

a sensor unit, which comprises a three-axis acceleration sensor and a three-axis magnetic field sensor, for determining the direction of the target object in the field of view; and a positioning unit for positioning the photoelectric sighting device.

2. The photoelectric sighting device capable of performing 3D positioning and display of a target object according to claim 1, wherein the sensor unit further comprises a group of other sensors besides the three-axis accelerometer and the three-axis magnetic field sensor, and the group of other sensors comprises two or more sensors selected from the group consisting of a wind speed and direction sensor, a temperature sensor, an air pressure sensor and a humidity sensor.

3. The photoelectric sighting device capable of performing 3D positioning and display of a target object according to claim 1, wherein the sighting circuit unit is provided with a 3D positioning unit and a 3D image creation unit.

4. The photoelectric sighting device capable of performing 3D positioning and display of a target object according to claim 3, wherein the 3D positioning unit creates an O-XYZ 3D coordinate system, a center of which is the center of the field-of-view acquisition end of the field-of-view obtaining unit of the sighting device, and determines the position of the target object in the O-XYZ 3D coordinate system through the distance information acquired by the range-finding unit and the angle information acquired by the three-axis accelerometer and the three-axis magnetic field sensor.

5. The photoelectric sighting device capable of performing 3D positioning and display of a target object according to claim 4, wherein the Z axis direction of the O-XYZ 3D coordinate system is parallel to the gravity direction, with the direction departing from the center of the earth as the positive direction; the Y axis direction of the O-XYZ 3D coordinate system is perpendicular to the gravity direction, in the same plane with the sighting direction of the field-of-view obtaining unit, and with the direction along the sighted direction of the field-of-view obtaining unit as the positive direction; and the X axis direction of the O-XYZ 3D coordinate system is perpendicular to the O-YZ plane.

6. The photoelectric sighting device capable of performing 3D positioning and display of a target object according to claim 1, wherein the sighting circuit unit is connected with a memory card provided with a mother library of 3D electronic map, wherein the 3D positioning unit calls scene data at the coordinates of the photoelectric sighting device to create a 3D electronic map, loads the O-XYZ 3D coordinate system with the target object and the photoelectric sighting device to the 3D electronic map and acquires the coordinate of the target object in the coordinate system.

7. The photoelectric sighting device capable of performing 3D positioning and display of a target object according to claim 1, wherein the photoelectric sighting device further comprises a housing, the entirety of the housing is a detachable structure, inside the housing is an accommodation space, and all of the field-of-view obtaining unit, the display unit, the power supply, the range-finding unit, the sensor unit, the positioning unit and the sighting circuit unit are disposed in the same accommodation space; and the front end of the housing is provided with a protection unit, which is buckled thereon.

8. The photoelectric sighting device capable of performing 3D positioning and display of a target object according to claim 7, wherein the range-finding unit comprises a signal emitting end, a signal receiving end; the field-of-view obtaining unit comprises an optical image obtaining end; the signal emitting end, signal receiving end, and the optical image obtaining end are all disposed at a housing front end, the display unit being disposed at a housing rear end;

wherein the signal emitting end and the signal receiving end are symmetrically disposed at the optical image obtaining end; both of the signal emitting end and the signal receiving end project above the optical image obtaining end; a plane formed by the signal emitting end, the signal receiving end, and the optical image obtaining end is angled with a vertical face of a gun sight; and wherein the signal emitting end and the signal receiving end are disposed at an upper end or a lower end of the optical image obtaining end.

9. The photoelectric sighting device capable of performing 3D positioning and display of a target object according to claim 7, wherein the photoelectric sighting device further comprises three field-of-view regulating units, one field-of-view regulating unit being disposed on the display unit, one field-of-view regulating unit being disposed on the housing, while another field-of-view regulating unit being connected to the housing;

wherein the field-of-view regulating unit disposed on the display unit perform regulation to the field of view via touch display screen; the field-of-view regulating unit disposed on the housing includes external keys; the field-of-view regulating unit connected to the housing includes an external slot, an external connection line, and one or more external keys, the external keys being connected to the external slot through the external connection line;

one end of the external connection line is connected to the external slot, the other end comprises one or more end branches, the each end branch being connected to an external key; and on the external connection line, one end of a secure clip is provided fixedly or slidably, the other end of the secure clip is fixed on the gun or other fixable place.

10. The photoelectric sighting device capable of performing 3D positioning and display of a target object according to claim 9, wherein the secure clip is a "U"-shaped clip.

11. The photoelectric sighting device capable of performing 3D positioning and display of a target object according to claim 1, wherein the display unit further displays ancillary shooting information and work indication information, kinds and arrangement manner of the information being settable based on user needs; the ancillary shooting information includes environment information, distance information, horizontal angle information and vertical angle information, and wherein the environment information includes wind speed data, temperature data, barometric data, and magnetic field data; the angle information comprises elevation angle data and azimuth angle data.

12. The photoelectric sighting device capable of performing 3D positioning and display of a target object according to claim 11, wherein the work indication information comprises battery level information, wireless signal information, remaining recording time, multiple information, shift key and menu key.

13. The photoelectric sighting device capable of performing 3D positioning and display of a target object according to claim 12, wherein the photoelectric sighting device further comprises a wireless transmission module, the wireless transmission module is connected to an external device through a wireless connection manner, the wireless transmission module synchronously displays reticle, image, and information displayed on a display screen to the external device; and the wireless connection manner being a WiFi connection or other wireless network connection manner, the external device being a smart phone or other intelligent terminal device.

14. The photoelectric sighting device capable of performing 3D positioning and display of a target object according to claim 1, wherein the sighting circuit unit comprises an interface board and a core board provided thereon with a control unit comprising the 3D positioning unit and the 3D image creation unit, all of a field-of-view driving circuit of the field-of-view obtaining unit, a distance measurement control circuit in the range-finding unit, an output end of the sensor unit, a key control circuit of a key unit and a battery control circuit of a battery assembly are connected on the core board via the interface board, and a display driving circuit of the display unit is connected on the core board.

15. The photoelectric sighting device capable of performing 3D positioning and display of a target object according to claim 14, wherein the memory card is disposed on the core board and provided therein with a bullet information database and two ballistic calculation model systems; and the control unit further comprises a ballistic model calculation unit having an exterior ballistic six-degree-of-freedom rigidity model and a low trajectory ballistic model.

16. The photoelectric sighting device capable of performing 3D positioning and display of a target object according to claim 15, wherein parameters inputted in the external ballistic 6-degree-of-freedom rigidity model include:

1) atmosphere condition: wind speed, wind direction, temperature, air pressure, humidity;
2) shooting position: longitude and latitude, and an elevation coordinate of a shooting point;
3) shooting condition: initial velocity and direction of the bullet at the gun barrel outlet, wherein the direction is represented by the elevation angle and azimuth angle of the gun barrel;
4) bullet-target distance: obtained through the range-finding unit; and
5) bullet data: mass of the shot, cross-section area of the shot, mass eccentricity (or rotational inertia) of the shot, and resistance coefficient, data about the bullet being stored in the bullet information database.

17. The photoelectric sighting device capable of performing 3D positioning and display of a target object according to claim 1, wherein, after performing an initial preparation, performing manual calibration and/or automatic simulated calibration.

18. The photoelectric sighting device capable of performing 3D positioning and display of a target object according to claim 17, wherein the automatic simulated calibration is simulating an impact point through one of the ballistic models and making the reticle in coincidence with the simulated impact point.

* * * * *